United States Patent [19]

Wang

[11] Patent Number: 4,773,104

[45] Date of Patent: Sep. 27, 1988

[54] INFLATABLE BATH-POOL WITH MEANS PRODUCING MASSAGING FLUID JET

[76] Inventor: Cheng-Chung Wang, 12th Fl., No. 440, Sec. 4, Jen-Ai Rd., Taipei, Taiwan

[21] Appl. No.: 100,525

[22] Filed: Sep. 24, 1987

[51] Int. Cl.[4] ..... A61H 33/02; A47K 3/10; E04H 3/18

[52] U.S. Cl. ..... 4/492; 4/507

[58] Field of Search ..... 4/542, 541, 543, 544, 4/545, 507–509, 492, 494, 490, 506, 489, 538, 599, 661, 588, 487, 488; 52/2 R, 2 N, 2 J; 383/3; 128/369, 400, 66

[56] References Cited

U.S. PATENT DOCUMENTS 3,986,217 10/1976 Doerr et al. ..... 4/542
4,019,210 4/1977 Patterson et al. ..... 4/506
4,546,505 10/1985 Wakenshaw ..... 4/543
4,547,919 10/1985 Wang ..... 4/455
4,607,400 8/1986 Goodman ..... 4/541
4,637,080 1/1987 Hutchinson ..... 4/542

FOREIGN PATENT DOCUMENTS 1109209 9/1981 Canada ..... 4/492

*Primary Examiner*—Henry J. Recla
*Attorney, Agent, or Firm*—McGlew and Tuttle

[57] ABSTRACT

The inflatable bath-pool incorporates water inlet and outlet means, and an inlet water control means which produces a high velocity flow of an air-and-water mixture to provide a massaging jet for the user. Mounting means are provided for mounting the inlet and outlet means as well as the inlet water control means on the pool. The bath pool is connected with external inlet and outlet pipes which are connected to a pump, a water heating means, a temperature control means, and a filter.

19 Claims, 12 Drawing Sheets

INFLATABLE BATH-POOL WITH MEANS PRODUCING MASSAGING FLUID JET

BACKGROUND OF THE INVENTION

This invention relates to a bath-pool of the type incorporating water inlet and outlet means and an inlet control means which can produce a high velocity inlet flow and draw air into the inlet flow for jetting air bubbles together with a jet of water, which can provide a massaging effect, and particularly to an inflatable bath-pool having the above-mentioned means.

SUMMARY OF THE INVENTION

An object of the invention is to provide an improvement for conventional bath-pools of the above-described type which have the disadvantage of being inconvenient to transport and being immovable after being installed because of their rigid and bulky construction.

Another object of the invention is to provide an inflatable bath-pool which is less expensive than the conventional bath-pools.

Accordingly, the invention provides an inflatable bath-pool assembly which comprises: an inflatable pool having an inflatable surrounding wall constituted of a plurality of sheet layers which are heat sealed together to form a plurality of longitudinal air compartments, and a base connected to the surrounding wall; an inlet water control tube to be connected to an external inlet water pipe and to be mounted on the pool and including an air conduit and a nozzle means for producing a high velocity inlet water flow as well as for drawing air into the inlet water flow; an inlet water discharging member connected with the inlet water control tube; an outlet water pipe coupling tube to be connected to an external outlet water pipe and to be mounted on the pool; an outlet water suction means connected to the outlet water pipe coupling tube; first mounting means heat sealed to said pool for mounting the inlet water control tube and the inlet water discharging tube; and second mounting means heat sealed to the pool for mounting the outlet water pipe coupling tube and the water suction means.

In one aspect of the invention, the assembly further includes an external inlet water pipe connected to the inlet water control tube, an external outlet water pipe connected to the outlet water pipe coupling tube, a pump connected to the inlet and outlet water pipes for circulating water, and a filter means connected to said external inlet water pipe for filtering the inlet water.

The surrounding wall of the pool may include an inlet opening and an outlet opening, wherein the inlet water discharging member is threadedly coupled with the inlet water control tube and inserted in the inlet opening, the first mounting means is an annular flange formed on the inlet water discharging member and heat sealed to the sheet layers of the surrounding wall, and the second mounting means includes a tubular insert member inserted into the outlet opening and having an annular flange which is heat-sealed to the sheet layers of the surrounding wall and two opposed threaded end portions coupled with the outlet water control tube and the water suction means.

In another aspect of the invention, the first or second mounting means includes a tubular insert member inserted into the inlet or outlet opening and having two opposed annular end flanges heat-sealed together with all of the sheet layers of the pool and two opposed threaded coupling end portions. Alternatively, the annular end flanges of the first or second mounting means may be heat-sealed respectively to the opposed outermost sheet layers of the pool.

In still another aspect of the invention, the first and second mounting means incorporate with one another, and include a rigid enclosed casing member communicated with the external inlet water pipe and secured to the pool, a branch tube extending away from the enclosed casing and being connected to the inlet water control tube, and an inner tube extending through the rigid enclosed casing and connected to the external outlet water pipe and the suction member.

The exemplary preferred embodiment will be described in detail with reference to the accompanying drawings, in which:

DETAILED DESCRIPTION OF THE PREFERRED EMBODIMENTS

Figure 1:
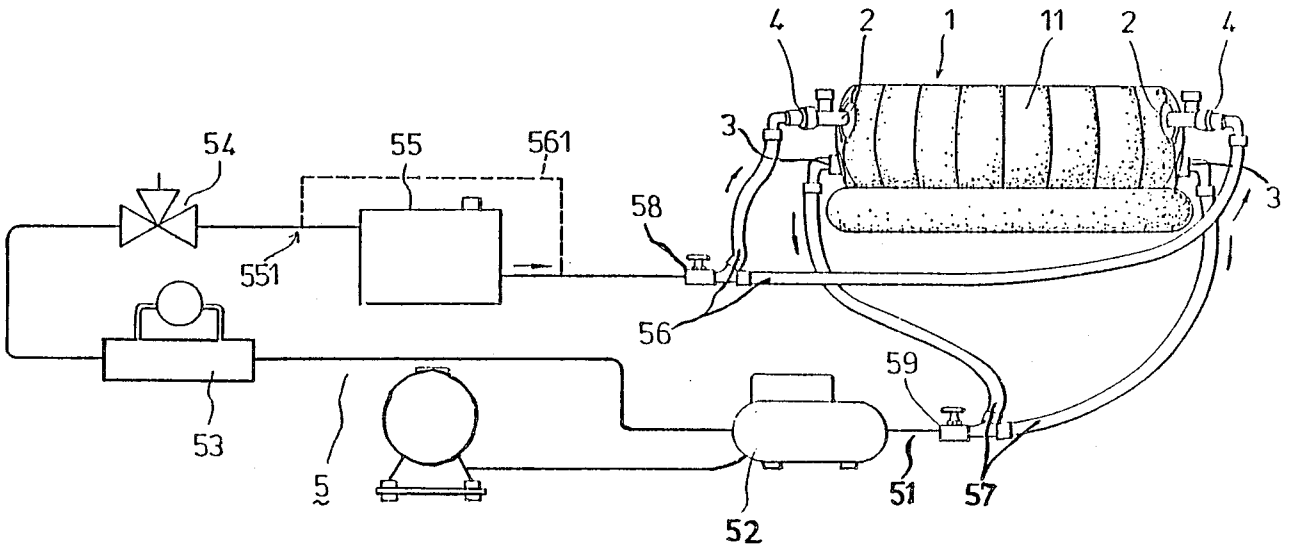
FIG. 1 shows an inflatable bath-pool assembly constructed according to the present invention.

Referring to FIG. 1, there is shown an inflatable pool 1 which is provided with openings (not shown) for attachment of inlet water pipe mounting means 2 and outlet water pipe mounting means 3 respectively.

Figure 5:
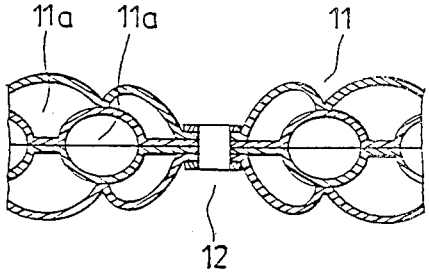
FIG. 5 and 6 are sectional views showing how a tubular insert member is heat-sealed to the wall of the pool.
Figure 6:
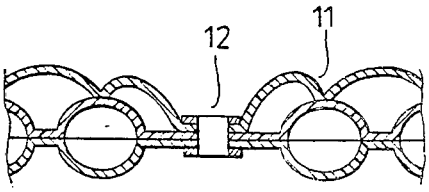

The inflatable pool 1 has an inflatable wall 11 with a construction which is disclosed in U.S. Pat. No. 4,651,360 of the applicant of the present invention. As is shown in FIGS. 5 and 6, the wall 11 may be formed by four or three sheet layers and include a plurality of longitudinal air compartments 11*a*.

Figure 2:
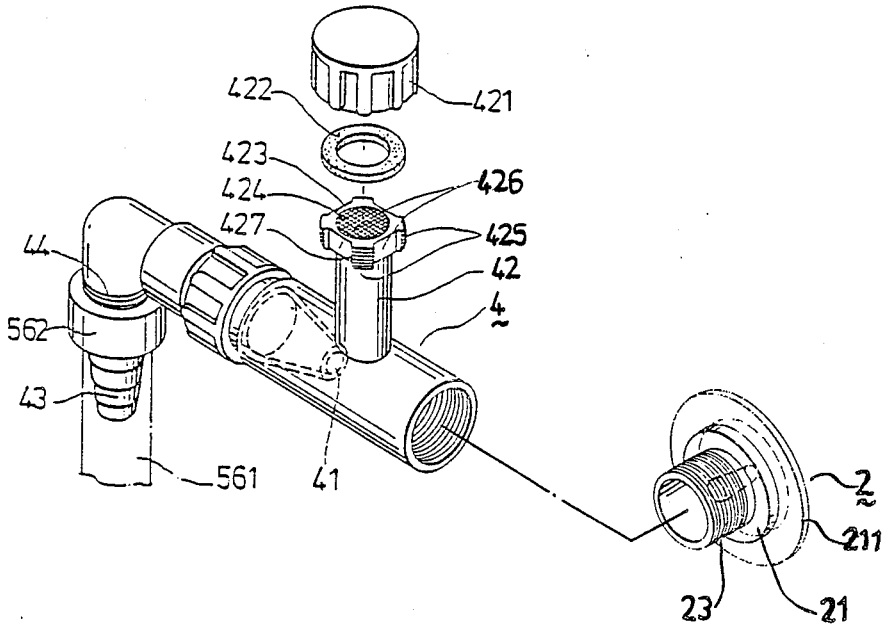
FIG. 2 is a perspective view showing an inlet water control tube and an inlet water discharging member.
Figure 3:
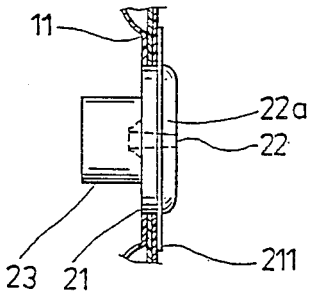
FIG. 3 is a fragmentary view showing the inlet water discharging member which is heat-sealed to the pool.

Referring to FIGS. 2 and 3, the inlet water pipe mounting means 2 has a tubular insert member 21 inserted into each opening of the wall 11 and having an annular flange 211 heat-sealed to the wall 11. The insert member 21 is integrally formed with an inlet water discharging nozzle member 22 for jetting water into the pool and an outwardly projecting threaded member 23 to be connected to an inlet water control tube 4. A direction adjusting member 22a is provided for adjustment of the direction of the water jetted by the nozzle.

Figure 7:
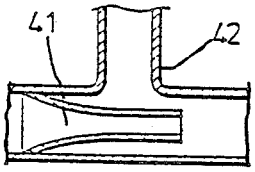
FIGS. 7 and 8 show the arrangement of the nozzle in the inlet water control tube.
Figure 8:
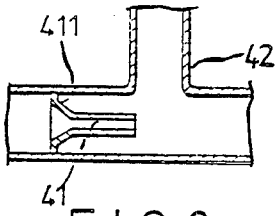

The inlet water control tube 4 is connected threadedly to the threaded portion 23 of the mounting means 2. Inside the inlet water control tube 4 is integrally formed a converging nozzle section 41 which is arranged to be in communication with an air conduut 42 for drawing air into the control tube 4. The air conduit 42 has an inlet end 423 on its outer periphery are spaced apart projections 425 which are provided for confining access grooves 426. A cap 421 is connected threadedly with the inlet end 423 by means of screws threads 427 disposed on the projections 425. A filter 424 provided at the inlet end 423 and a sealing ring 422 is disposed between the inlet end 423 and the cap 421. By turning the cap 421, the gap between the cap 421 and the inlet end 423 can be adjusted for admission of air. The converging nozzle section 41 is provided in the tube 4 for producing a high velocity inlet water flow in the tube 4. The position of the air conduit 42 relative to the throat of the nozzle 41 can be chosen particularly to achieve a desired rate of the flow of the air water mixture in the tube 4 and a desired air-water ratio. As shown in FIG. 7, when the throat of the nozzle 41 is disposed downstream of the air conduit 42, the air suction pressure is large. When the throat of the nozzle 41 is disposed just upstream of the air conduit 42 and a sudden change in cross-section is created at the upstream end of the nozzle 41, as shown in FIG. 8, the velocity of the inlet fluid flow can be reduced. Since the air conduit projects upwardly, a holding means such as a hook-and-loop fastening pad called VELCRO can be used to hold the air conduit against the wall of the pool so that the air conduit will not move downwardly. The control tube 4 further has a tapered coupling portion 43 to be inserted into a tapered portion 561 of an inlet water pipe 56 through a threaded coupling member 562 which is screwed to a threaded part 44 of the tapered portion 43.

Figure 4:
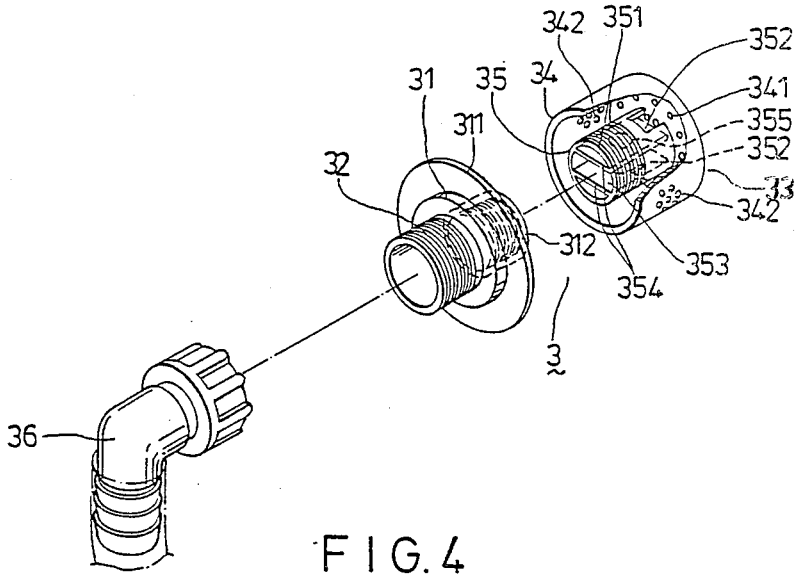
FIG. 4 is a perspective view showing an inlet water pipe coupling tube and a water suction member.

Referring to FIG. 4, the outlet water pipe mounting means 3 includes an insert portion 31 inserted into the opening of the inflatable wall 11, an outwardly projecting threaded joint portion 32 to be connected with a coupling member 36 of an outlet water pipe 57, and an inwardly projecting threaded joint portion 312 connected with a suction member 33. On the insert portion 31 is an annular flange which is heat sealed to the wall 11 in the same manner as the flange of the inlet water pipe mounting means 2.

The suction member 33 includes an outer casing which has a peripheral surrounding wall 34 and a front wall provided with perforations 342 and 341 respectively, and an inner tube 35 with a threaded portion 351 connected to the threaded joint portion 312 of the mounting means 3. The inner tube is provided with an opening 352 on the periphery thereof which is communicated with an innermost axial passage 353 which is confined by two partition plates 354. The partition plates 354 are provided with openings 355 by which the water admitted through the perforations 341 and 342 can make a turn passing through the openings 352 and 355 and flow into the innermost axial passage 353. This reduces the suction force of the suction member 33. The water drawn into the axial passage will then be mixed with the water which enters through the front openings 341 of the outer casing 34. This also reduces the suction force of the suction member 33.

Referring again to FIG. 1, the control members 4 are connected through inlet water pipes 56 to a pump 52, a water heating means and a temperature control means which are designated at 53, a three-way valve 54, and a filter 55. Two outlet water pipes 57 are connected to the outlet water pipe mounting members 3 as well as to the pump 52, thereby enabling the water of the pool to circulate through the filter 55. When the pool is not used, the water can be discharged through the three-way valve 55. Flow control valves 58 and 59 are connected to the pipes 56 and 57 so as to regulate the inlet and outlet water. Alternatively, a water tap can be disposed upstream of the valve 59 to discharge waste water.

In order to eliminate the need to contact a switch of the pump with a wet hand of the user, a compressible air bulb can be connected to the wall 11 by heat-sealing and then connected to the switch of the pump through an air pipe. As such, the switch can be actuated by operating the air bulb.

Figure 9:
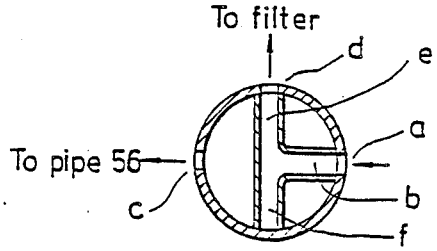
FIGS. 9, 10, 11 and 12 show the operation of a three-way valve.
Figure 10:
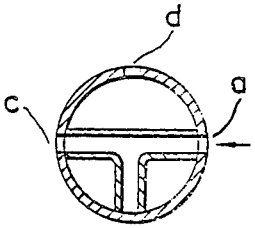
Figure 11:
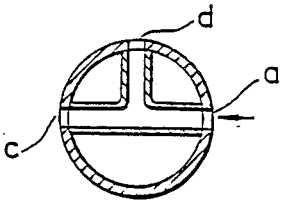
Figure 12:
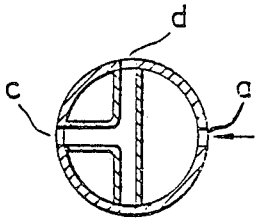

Furthermore, for smooth operation of the filter 55, an additional three-way valve can be disposed upstream of the filter 55, for instance, at the location designated by 551. In this case, a branch line such as that shown by a dotted line 561 is necessary so as to permit water to flow therethrough without passing the filter 55. As shown in FIGS. 9, 10, 11 and 12, the three-way valve is arranged such that it has one inlet opening a, one inlet passage b, two outlet openings c and d and two outlet passages e and f. When the valve is in the position as shown in FIG. 9, all the inlet water will be filtered out; when in the position as shown in FIG. 10, all the inlet water will flow to the inlet water pipe 56 without being filtered; when in the position as shown in FIG. 11, the water flow is divided and directed to both filter 55 and pipe 56; and, when in the position shown in FIG. 12, the three-way valve is closed.

Figure 22:
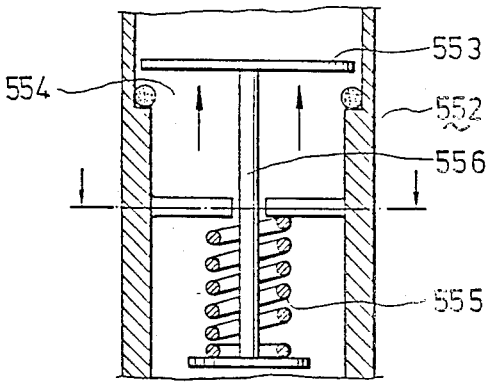
FIGS. 22 and 23 are sectional views of a valve that can be mounted in line 561 to control water flow around filter 55.
Figure 23:
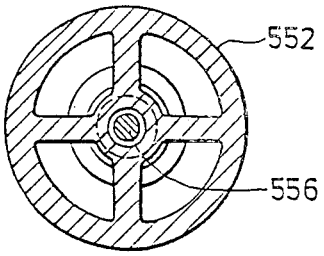

Alternatively, a valve 552 which is shown schematically in FIGS. 22 and 23 can be used instead of the above-described three way valve. The valve 552 is a conventional valve and includes a valve stem 556 with a valve disc 553 which is urged by a spring 555 to normally close a valve opening 554. The spring 555 permits the valve disc 553 to open only when it is compressed by a high velocity water flow. The valve 552 is used to close the line 561 when the velocity of the water is low so that the water flows only through the filter 55. When the velocity is high, the valve 552 is opened and the water flows through the line 561 as well as through the filter 55.

Figure 13:
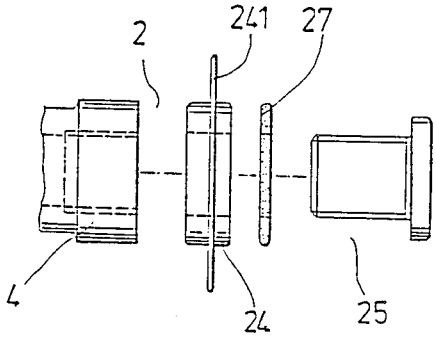
FIG. 13 shows an inlet water discharging member separated from the mounting means.

As shown in FIG. 13, the inlet water pipe mounting means 2 may be constituted of separable parts instead of the one-piece element as described hereinbefore. The parts include a tubular insert member 24 to be inserted in the inlet water opening of the wall 11, which has an annular flange 241 to be heat-sealed to the wall 11 of the pool 1, and an inlet water discharging member 25 which has a nozzle piece therein and which is inserted threadedly into the insert member 24. A sealing member 27 is provided between the members 24 and 25. The inlet water control tube 4 is connected threadedly with the inlet water discharging member 25.

Figure 14:
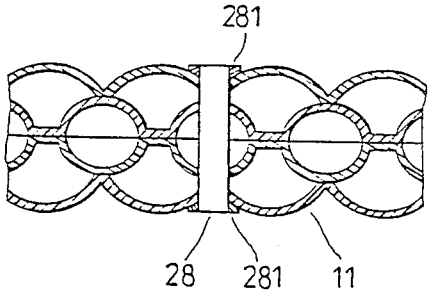
FIG. 14 shows a tubular insert member with two end flanges heat-sealed to the wall of the pool.

Referring again to FIGS. 5 and 6, the inlet water or outlet water pipe mounting means 2 or 3 may be a tubular insert memer 12 which has two opposed end flanges heat-sealed together with all sheet layers of the wall 11. Alternatively, the pipe mounting means 2 or 3 can be attached to the wall 11 by using a tubular insert member 28 which has two end flanges 281 as shown in FIG. 14. In this case, the end flanges 281 are heat-sealed respectively to two opposite outermost sheet layers of the wall 11. The insert member 12 or 28 has two opposed internally threaded end portions to be coupled respectively with the outlet water pipe coupling tube 36 and the suction means 33, or the inlet water control tube 4 and the inlet water discharging member 25.

Figure 15A:
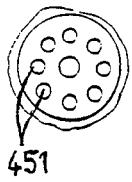
FIGS. 15*a*, 15, 16 and 17 show various forms of nozzles used in the inlet water control pipe.
Figure 15:
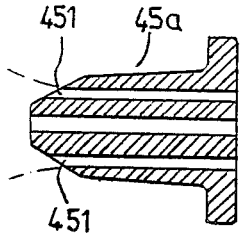
Figure 16:
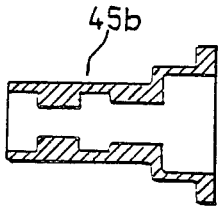
Figure 17:
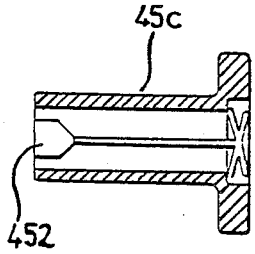

Referring to FIGS. 15, 16 and 17, the nozzle 41 in the control member 4 may be in various forms; for instance, a nozzle 45*a* of FIG. 15 having a central axial passage and a plurality of axial passages 451 disposed annularly around the central passage, a nozzle 45*b* of FIG. 16 having two spaced apart annular grooves therein, and a nozzle of FIG. 17 having a coneshaped body 452 therein in which helical grooves may be provided on either the cone-shaped body 452 or the inner surface of the nozzle housing.

Figure 18:
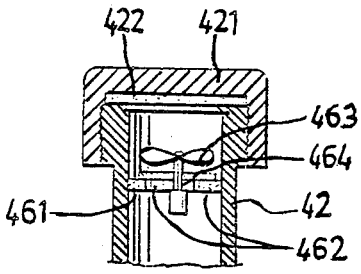
FIG. 18 shows a means for intermittently closing the inlet of the air conduit.

Referring to FIG. 18, the air conduit 42 of the control tube 4 may be provided with a means for intermittently admitting air in the air conduit 42. The means 46 includes a plate 461 having two openings 462 which is mounted in the air conduit 42, and a propeller blade 463 which is mounted rotatably on the plate 461 and connected with a rotatable cover plate 464. When the blade 463 rotates due to the entering air, the cover plate 464 will close intermittently the openings 462 of the plate 461.

Figure 19:
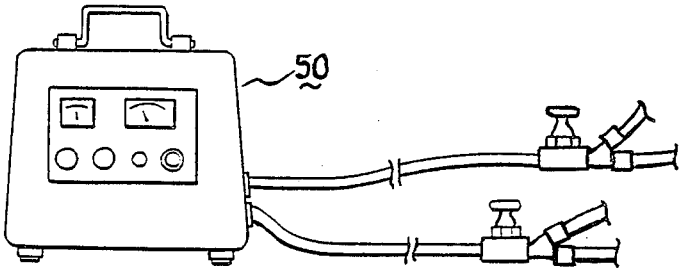
FIG. 19 shows a portable casing for containing the operating means of the pool.

For the purpose of convenient operation and transportation, the pump and other operating means to connected to the pool 1 can be arranged in a casing such as that designated at 50 in FIG. 19. The casing may contain a support body which holds the pump 52, and the heating unit 53, and a water collecting means for collecting water dripping from the parts holding water.

Figure 20:
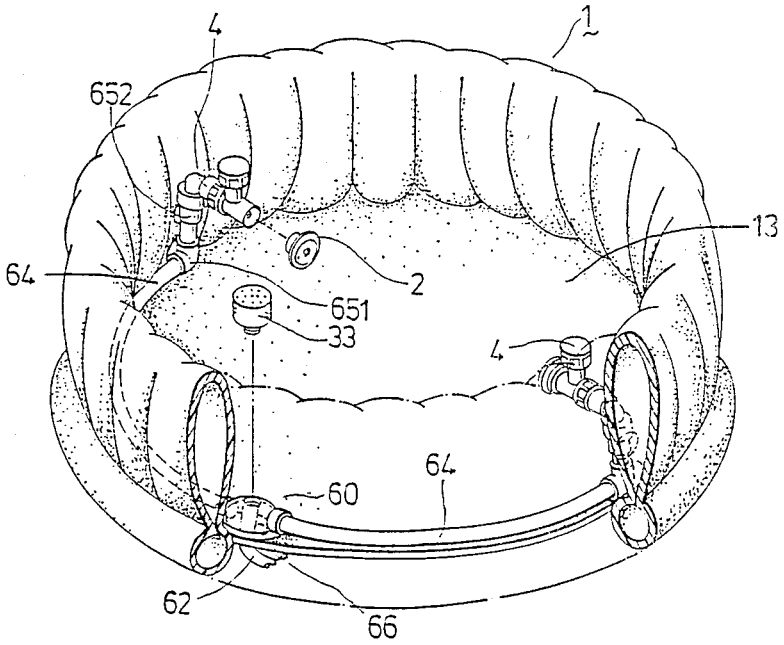
FIG. 20 shows another way of mounting the inlet and outlet water pipes on the pool.

According to the present invention, the inlet and outlet water pipes 56 and 57 can be also connected to the pool 1 as shown in FIG. 20, instead of being connected to the wall 11 as described hereinbefore. In this case, the base 13 of the pool is provided with an opening, and to the base 13 of the pool is heat-sealed a rigid enclosed casing 60. An inner tube 62 is coupled integrally with the rigid enclosed casing 60 and extends outwardly of the pool 1 to be connected to the external outlet water pipe. The suction member 33 is connected to the inner tube 62 inside the pol. Two branch tubes 64 are communicated with the enclosed casing 60 inside the pool 1 and extend away from the casing 60. The branch tubes 64 are immobilized by means of sleeve members 651 and 652 which are secured to the wall 11 by heat-sealing. Alternatively, the sleeve members can be secured releasably to the wall of the pool by using a hook-and-loop fastener means called Velcro. The inlet water control tube 4 and the discharging member 2 are mounted on the extension tubes 64. The enclosed casing 60 has an inlet means 66 outside the pool to be connected to the external inlet water pipe.

Figure 21:
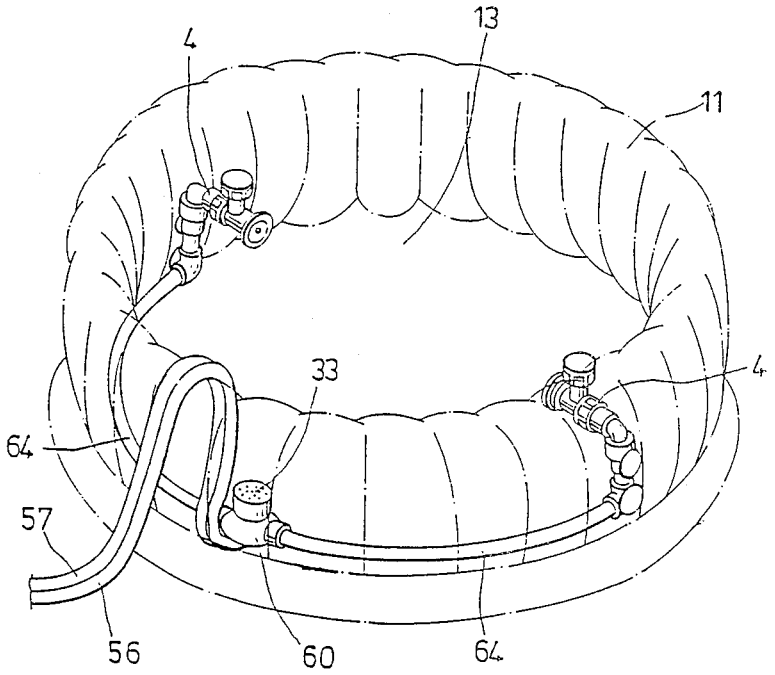
FIG. 21 shows still another way of mounting the inlet and outlet water pipes on the pool.

Referring to FIG. 21, the external inlet and outer water pipe 56 and 57 can be directed into the pool 1 and connected respectively to the inlet water control tube 4 and the suction member 33. In this case, the casing 60 is communicated with the inlet water pipe 56 which extends into the pool from the upper side of the pool, and the inner tube (not shown) which extends in the casing 60 is communicated with the external outlet water pipe 57 which extends into the pool. The casing 60 can be secured to the base 13 or the wall 11 of the pool by means of hook-and loop fastener means which facilitates the attaching or detaching of the casing 60.

What I claim is:

1. An inflatable bath-pool assembly comprising:

an inflatable pool having an inflatable surrounding wall constituted of a plurality of sheet layers which are heat sealed together to form a plurality of longitudinal air compartments, and a base connected to said surrounding wall;

an inlet water control tube having one end adapted to be connected to an external inlet water pipe and an opposit end connected to the interior of said pool and including an air conduit and a nozzle means for producing a high velocity inlet water flow as well as for drawing air into said inlet water flow;

an inlet water discharging member connected with said inlet water control tube;

an outlet water pipe coupling tube having one end adapted to be connected to an external outlet water pipe and an opposite end connected to the interior of said pool;

an outlet water suction means connected to said outlet water pipe coupling tube;

first mounting means heat sealed to said pool wall for mounting said inlet water control tube and said inlet water discharging member; and second mounting means heat sealed to said pool wall for mounting said outlet water pipe coupling tube and said water suction means;

2. An inflatable bath pool assembly as claimed in claim 1, further comprising an external inlet water pipe connected to said inlet water control tube, an external outlet water pipe connected to said outlet water pipe coupling tube, a pump connected to said external inlet and outlet water pipes for circulating water, and a filter means connected to said external inlet water pipe for filtering the inlet water.

3. An inflatable bath pool assembly as claimed in claim 1, in which said surrounding wall of said pool includes an inlet opening and an outlet opening, wherein said inlet water discharging member is threadedly coupled with said inlet water control tube and inserted in said inlet opening, said first mounting means is an annular flange formed on said inlet water discharging member and heat sealed to said sheet layers of said surrounding wall, and said second mounting means includes a tubular insert member inserted into said outlet opening, and having an annular flange which is heat-sealed to said sheet layers of said surrounding wall, and two opposed threaded end portions coupled with said outlet water control tube and said water suction means.

4. An inflatable bath pool assembly as claimed in claim 1, in which said surrounding wall of said pool includes an inlet opening and an outlet opening, wherein each of said first and second mounting means includes a tubular insert member inserted into said inlet or outlet opening, and having two opposed annular end flanges heat-sealed together with all of said sheet layers of said pool, and two opposed threaded coupling end portions.

5. An inflatable bath pool assembly as claimed in claim 1, in which said surrounding wall of said pool includes an inlet opening and an outlet opening, and said sheet layers includes two opposed outermost sheet layers, wherein each of said first and second mounting means includes a tubular insert member having two opposed end flanges respectively heat-sealed to said outermost sheet layers, and two opposed threaded coupling end portions.

6. An inflatable bath pool assembly as claimed in claim 1, wherein said first and second mounting means incorporate with one another, which includes a rigid enclosed casing member communicated with the external inlet water pipe and secured to said pool, a branch tube extending away from said enclosed casing and being connected to said inlet water control tube, and an inner tube extending through said rigid enclosed casing and connected to the external outlet water pipe and said suction member.

7. An inflatable bath pool assembly as claimed in claim 6, wherein said base of said pool has an opening therein and said enclosed casing is heat-sealed to said said base at said opening of said base, said enclosed casing having an inlet outside said pool for communicating with the external inlet water pipe, said inner tube of said mounting means extending outwardly of said pool through said casing and being connected to the external outlet water pipe.

8. An inflatable bath pool assembly as claimed in claim 6, wherein said first and second mounting means further includes a hook-and loop fastener means to secure detachably said enclosed casing to said pool, said enclosed casing and said inner tube of said mounting means being communicated respectively with the external inlet and outlet water pipes which extend into said pool.

9. An inflatable bath pool assembly as claimed in claim 1, wherein said water suction means includes an outer casing having a surrounding wall and a front wall both of which have perforations therein for access by the outlet water, and an inner tube surrounded by said outer casing and having a tube wall with first opening means and partition plate members in said tube wall which confine an innermost axial passage to be communicated with said outlet water pipe coupling tube and which has second opening means, said first and second opening means and said perforations being staggered relative to each other to cause the outlet water to be suctioned along a turning path with a reduced suction force.

10. An inflatable bath pool assembly as claimed in claim 1, wherein said nozzle of said inlet water control tube is a converging nozzle integrally formed in said inlet water control tube for producing a high velocity inlet flow.

11. An inflatable bath-pool assembly as claimed in claim 10, wherein said converging nozzle has a throat section substantially downstream of said air conduit.

12. An inflatable bath pool assembly as claimed in claim 10, wherein said converging nozzle has a throat section substantially upstream of said air conduit.

13. An inflatable bath pool assembly as claimed in claim 1, wherein said inlet water discharge member includes a nozzle and a direction control member for controlling the direction of the jetted inlet water.

14. an inflatable bath pool assembly as claimed in claim 1, wherein said air conduit includes an air inlet end which has an outer periphery with spaced apart projections which confine air access grooves, a cap threadedly connected to said outer periphery for confining a gap intercommunicating said access grooves and said air inlet end as well as for adjustment of said gap, and a sealing ring between said cap and air inlet end.

15. An inflatable bath pool assembly as claimed in claim 12, wherein said air conduit further includes a fixed cover plate in said inlet end, having an opening, a propeller blade mounted rotatably on said cover plate, and a movable cover plate connected to said propeller blade to rotate simultaneously with said propeller blade so as to close intermittently said opening of said fixed cover plate.

16. An inflatable bath pool assembly as claimed in claim 2, further comprising valve means upstream of said filter means.

17. An inflatable bath pool assembly as claimed in claim 2, further comprising means for heating water and controlling the temperature of the water.

18. An inflatable bath pool assembly as claimed in claim 16, wherein said valve means includes a three-way valve which completely stops water from flowing through said filter, permits water to flow partially through said filter, or allowing water to flow entirely through said filter.

19. An inflatable bath pool assembly as claimed in claim 16, wherein said valve means includes a pressure valve which includes a valve casing having a passage, a valve disc for closing said passage, and a spring for urging said valve disc to close said passage in a normal position, said valve disc permitting water to flow partially through said filter when the velocity of the water is high.

* * * * *